US006119612A

United States Patent [19]

Bottoms et al.

[11] Patent Number: 6,119,612

[45] Date of Patent: Sep. 19, 2000

[54] HEM FORMER WITH MOVABLE SUPPORT PLATE

[75] Inventors: Joseph A. Bottoms; Ronald C. Lovejoy, both of Barnesville, Ga.

[73] Assignee: Bottoms Associates, Inc., Barnesville, Ga.

[21] Appl. No.: 09/207,566

[22] Filed: Dec. 8, 1998

[51] Int. Cl.[7] ..... D05B 35/02

[52] U.S. Cl. ..... 112/475.06; 112/141; 112/153

[58] Field of Search ..... 112/141, 147, 112/151, 153, 136, DIG. 2, 475.03, 475.06, 475.26

[56] References Cited

U.S. PATENT DOCUMENTS

| | | | |
|---|---|---|---|
| 2,419,068 | 4/1947 | Gensheimer | 112/141 |
| 3,326,155 | 6/1967 | Paolicelli | 112/141 |
| 3,595,187 | 7/1971 | Gray | 112/141 |
| 3,631,826 | 1/1972 | Morgan | 112/141 |
| 3,776,156 | 12/1973 | Morgan | 112/141 |
| 4,186,674 | 2/1980 | Conner, Jr. | 112/153 |
| 4,287,841 | 9/1981 | Rovin | 112/121.11 |
| 4,590,876 | 5/1986 | Mencke et al. | 112/262.3 |
| 4,655,150 | 4/1987 | Romano | 112/153 |
| 4,947,771 | 8/1990 | Miyachi et al. | 112/141 |
| 5,033,399 | 7/1991 | Miyachi et al. | 112/142 |
| 5,197,400 | 3/1993 | Prais | 112/122.3 |
| 5,373,797 | 12/1994 | Bottoms et al. | 112/262.3 |
| 5,441,004 | 8/1995 | Bottoms et al. | 112/475.06 |
| 5,911,185 | 6/1999 | Pantusco | 112/141 |

FOREIGN PATENT DOCUMENTS

| | | |
|---|---|---|
| 2839399 | 9/1978 | Germany . |
| 614139 | 6/1978 | Russian Federation . |

OTHER PUBLICATIONS

Automated Seaming System For Any Standard Machine, Profeel, Inc., brochure.

*Primary Examiner*—Ismael Izaguirre
*Attorney, Agent, or Firm*—Kennedy, Davis & Hodge, LLP

[57] ABSTRACT

A hem former (16) for folding the margin of a sheet of material in preparation for sewing is mounted to the sewing bed (11) of a sewing machine (10). The hem former has a mounting plate (17), a guide plate (18) having a guide edge (23), a support plate (22) having a front edge (28) reciprocally mounted upon the guide plate and channels (24), and a guide cap (36). The guide cap has air nozzles (38) coupled to a supply of compressed air so as to generate an airstream directed beneath the front edge of the support plate and into the channels of the support plate. The airstream urges the margin of material over the front edge of the support plate and into abutment with the guide edge.

14 Claims, 3 Drawing Sheets

HEM FORMER WITH MOVABLE SUPPORT PLATE

TECHNICAL FIELD

This invention relates to formers and methods for folding back the margin of sheet material in preparation for sewing.

BACKGROUND OF THE INVENTION

The margin of sheet material, such as cloth, is often folded back and sewn to form a hem. The material may be manually folded back by a workers operating a sewing machine stitching the hem. However, in a commercially environment the manual folding and aligning of material is time consuming and inexact, often resulting in uneven hems or hems of different widths.

Formers have been provided which enable an operator to fold back the margin through the movement of the material through the former. Typically, these formers have plates which form a channel which progressively inverts the margin as the material is moved through the channel towards the sewing machine. However, to obtain a uniform hem these formers still rely on the operator's skill and close attention in directing the cloth through the former and in maintaining proper alignment of the material throughout sewing.

Formers have also been provided which use jets of air to urge material into a duct of the former. The duct has a guide at one end which the edge of the material abuts to maintain its alignment. This type of former is shown in U.S. Pat. No. 3,595,187. However, oftentimes the air from these jets causes the margin of the material to flutter, thus causing the margin to become misaligned.

A pneumatic hem former has also been designed having a reciprocating support plate mounted upon a guide wall having a series of orifices therein. A series of air nozzles generate air streams along the bottom of the support wall and into the channels or orifices. Such a device is shown in U.S. Pat. No. 5,373,797, which was invented by the Applicant herein. However, it has been found that loose threads associated with the edge of the working material becomes entrained into the air streams and pulled into the orifices of the guide walls. This often results in the material being pulled back by the loose threads in a direction opposite to the direction of material movement during sewing. When such occurs, the material becomes misaligned and the resulting sewn hem also is misaligned.

It thus is seen that a need remains for a former for folding back the margin of a sheet of material in a more efficient and effective manner. It is to the provision of such that the present invention is primarily directed.

SUMMARY OF THE INVENTION

In a preferred form of the invention, a hem former for folding back the margin of sheet material in preparation for sewing, comprises a support plate having an upper surface and a lower surface, the upper surface and the lower surface merging along an elongated front edge. The support plate has at least one channel extending from the lower surface adjacent the elongated front edge. The hem former also includes first guide means mounted adjacent the elongated front edge for deflecting the margin of the sheet material downward and second guide means mounted beneath the lower surface for aligning and guiding the margin of the sheet material. The support plate is mounted for reciprocal movement of the elongated front edge between a first position extending beyond the second guide means and proximal the first guide means and as second position retracted behind the second guide means and distal from the first guide means. The hem former also has means for moving the support plate, and means for generating an airstream flowing beneath the support bottom surface and into the support plate channels. With this construction, the margin of sheet material positioned upon the support plate in its first position is urged over the elongated front edge of the support plate and entrained into the air stream flowing from the means for generating an airstream so as to be folded back along the elongated front edge into abutment with the second guide means in preparation for sewing, and whereby the support plate is moved to its second position to complete the sewing of the margin.

DETAILED DESCRIPTION

Figure 1:
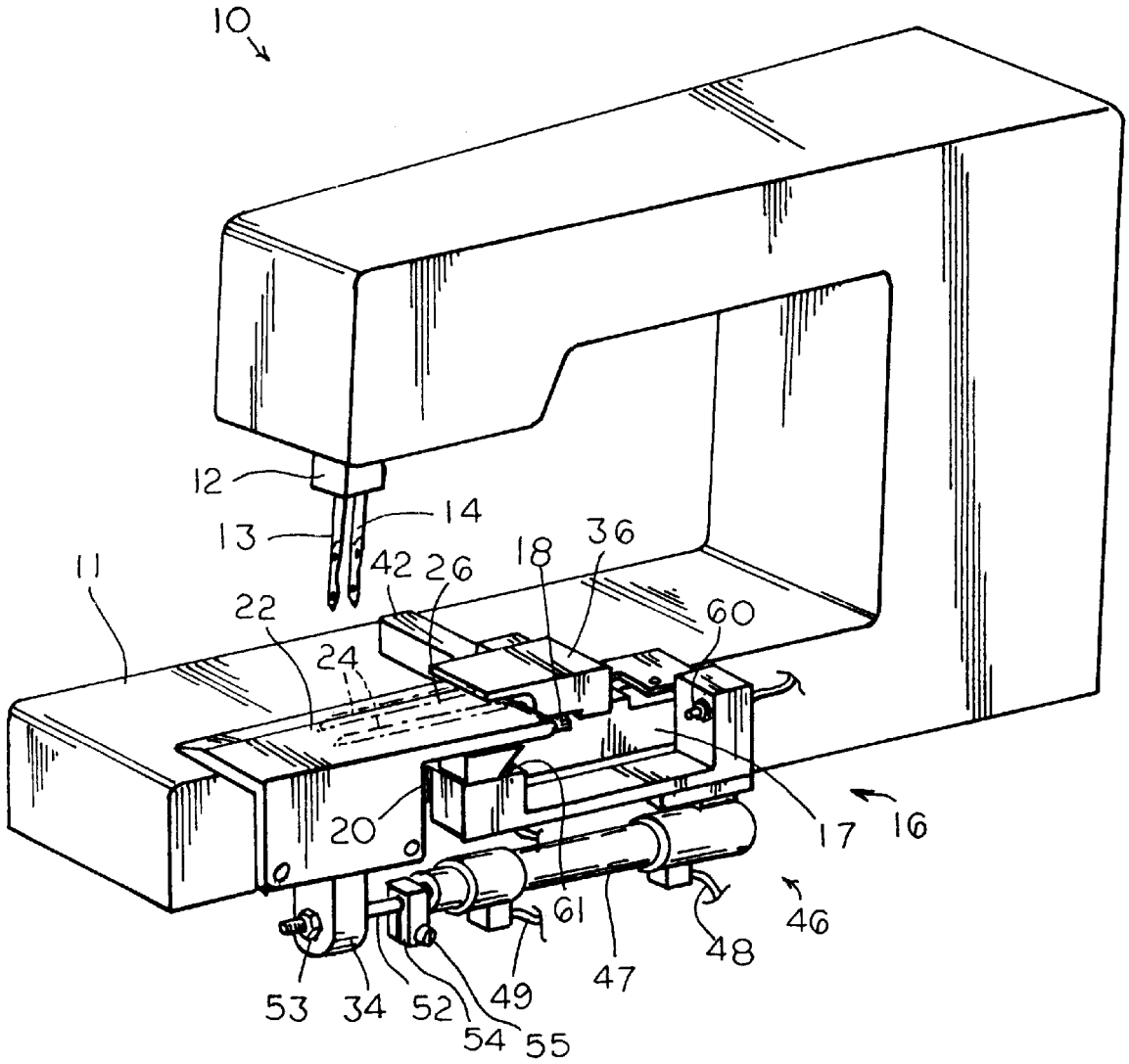
FIG. 1 is a perspective view of a conventional sewing machine to which a hem former embodying principles of the invention is mounted.

With reference next to the drawing, there is shown in FIG. 1 a conventional sewing machine 10 of the type having a sewing bed 11 and a sewing head 12 having a reciprocating outside sewing needle 13 and a reciprocating inside sewing needle 14. A hem former 16 is mounted upon the sewing bed 11. The hem former 16 comprises an elongated mounting plate 17, a spring biased adjustment plate 18 mounted upon the mounting plate 17, a guide plate 19 mounted upon the mounting plate 17, a support plate 22 reciprocally mounted upon an elongated guide rail 20 extending from the mounting plate 17. The guide plate 19 has a guide edge or front surface 23. The support plate 22 has a top surface 26, a bottom surface 27, an elongated front edge 28, and a downwardly depending guide track 29 configured to receive guide rail 20. The support plate 22 also has two elongated channels or orifices 24, shown in the form of troughs, extending from the bottom surface 27 adjacent the front edge 28 to a position generally along the center of the support plate. An end flange 34, having a hole 35 extending therethrough, depends from the bottom edge of guide track 29.

A guide cap 36 is mounted upon the mounting plate 17. The guide cap 36 has a U-shaped channel 37 and two laterally aligned air nozzles 38 extending therethrough. An air line 39 is coupled to the guide cap in fluid communication with the air nozzles 38. A hem finishing finger 42 is mounted to the guide cap 36.

A pneumatic drive 46 is mounted to the underside of the mounting plate 17. The pneumatic drive 46 has a cylinder 47 having an air line 48 mounted at one end and an air line 49 mounted adjacent its other end, and a piston movably mounted within the cylinder 47. The piston has a piston rod 52 extending from an end of the cylinder opposite air line 48 which is mounted within the end flange hole 35. A lock nut 53 is threadably mounted to the piston rod 52. A stop 54 having a set screw 55 is movably mounted to the piston rod. Air lines 39, 48 and 49 are connected to a source of air under pressure, such as an air compressor, and are regulated through actuation switches operable by an operator, such as a sewing machine operator.

A photoelectric emitter 60 and receiver 61 are mounted to the mounting plate 17. The emitter 60 directs a light beam below the support plate 22.

Operation of the hem former may best be understood by reference to FIGS. 2–6. Compressed air is passed through each air line 39, at a rate of approximately 4.9 scfm, to form an airstream emanating from each air nozzle 38. Each of these airstreams is directed below the front edge 28 of the support plate, along its bottom surface 27, and into a channel 24 of the support plate aligned with an air nozzle 38, as illustrated by the arrows depicted in FIG. 3.

Figure 5:
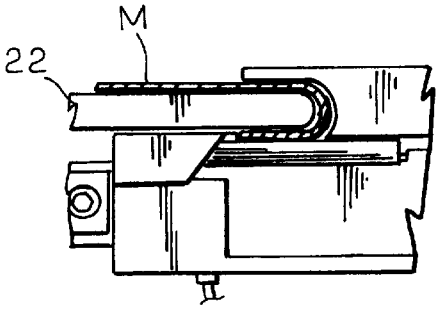

The margin of a sheet of material M is urged over the top surface 26 of the support plate and past its front edge 28. The edge of the material then drops over the front edge 28 where it is entrained into the airstream. Should the material be somewhat inflexible the U-shaped channel 37 aids in turning down the margin of the material into the path of the airstreams. The margin is then urged by the airstreams into abutment with the guide edge 23 of guide plate 19, as shown in FIG. 5. The channels 24 allow the majority of the airstreams to flow smoothly over the guide edge 23, so as not to create air turbulence in the general area of the guide edge which could cause the edge of the material to flutter. Although the apparatus is shown mounted to a horizontal surface it should be understood that it obviously may also be mounted to an incline or even vertical surface. Thus, the reference to "down" herein is only for ease of explanation.

Figure 6:
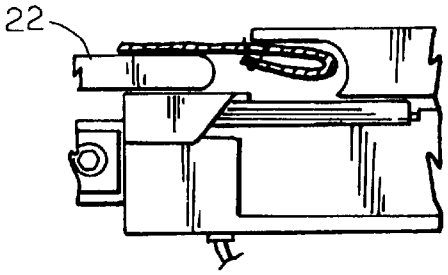

With actuation of the sewing machine 10 its feeding mechanism draws the material past the sewing needles 13 thereby stitching the turned down margin to the overlaying material thus completing the hem, as shown in FIG. 6. As the material is drawn laterally towards the head of the sewing machine, the air streams continually maintains the edge of the material in abutment with the guide edge 23. It should be noted that the air nozzles 38 are oriented approximately 5° towards the sewing needles. The forward angle of the air nozzles aids in moving the material laterally through the hem former 16.

Figure 2:
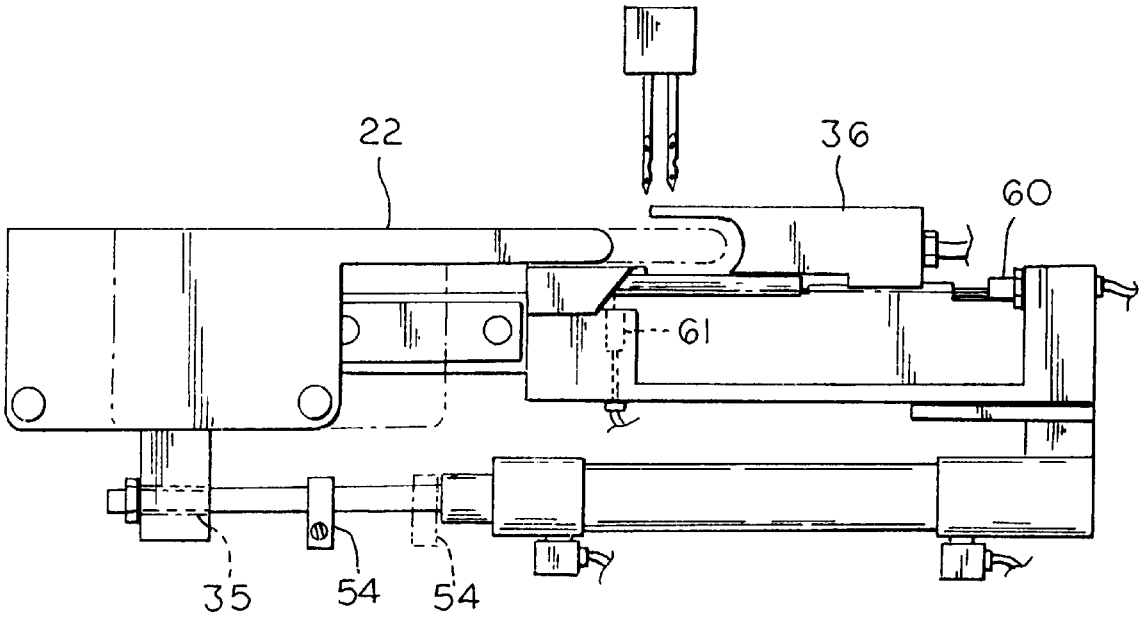
FIG. 2 is a side view of the hem former of FIG. 1 shown with a portion of a sewing head of the sewing machine and portions of the former removed for clarity.
Figure 3:
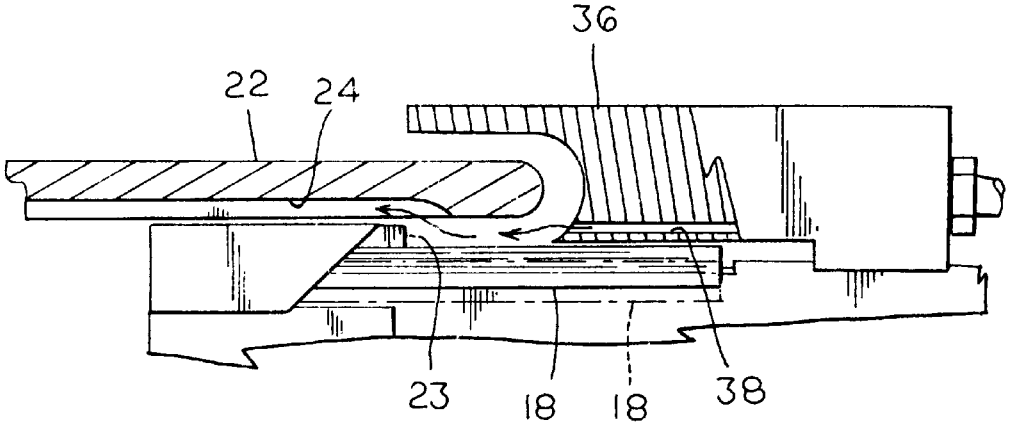
FIG. 3 is a cross-sectional view of a portion of the hem former of FIG. 1.
Figure 4:
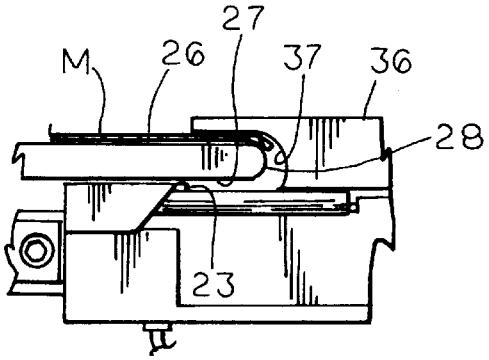
FIGS. 4–6 are a sequence of views of a portion of the hem former of FIG. 1 shown mounted to a sewing machine, which show, in sequence, a sheet of material being turned back by the hem former and sewn.

As the now sewn margin of the endless loop material approaches the hem former the material is raised to a position wherein it no longer breaks the light beam between the photoelectric emitter 60 and receiver 61. The sensing of the light beam causes the actuation, in a conventional manner, of the support plate 22 to a retracted position with it front edge removed from the U-shaped channel, as shown in FIGS. 2 and 6. This allows the previously sewn portion of sheet material of a continuous loop construction, such as the bottom of a T-shirt, to pass through the former unobstructed by the support plate so it may be sewn with an overlying stitch. To do so, the pneumatic drive 46 is actuated by forcing compressed air into the cylinder through air line 48 so as to drive the piston rod 52 from the cylinder. The support plate is thereby retracted to a position wherein its front edge 28 is positioned over the guide plate 19 and behind the guide edge 23 of the guide plate.

It should be understood that should the material include a side seam or similar joining seam, typically oriented perpendicular to the edge of the material, the spring biased adjustment plate 18 is biased downwardly by the seam as it passes between the support plate and the adjustment plate. This resolves a problem long associated with hem formers of the prior art wherein the seam could become bound in the former, resulting in an improperly formed hem.

The retracted position of the support plate 22 may be adjusted by threading the piston rod 52 into the end plate hole 35. The further the piston rod is threaded into the end plate the closer the front edge 28 of the support plate is positioned to the guide edge 23. The proper position of the front edge is determined by the width of the hem since wider hems expand further than narrower hems when pressed by the finishing cover 42. Therefore, wide hems require the front edge 28 to be positioned farther behind the guide edge than narrow hems. The threaded position of the piston rod is maintained by tightening lock nut 53 against the end flange 34.

It should be noted that the just described retracted positioning of the support plate 22 is intended for the cover stitching of raw edged material. However, it should be understood that the hem former 16 may be used with other types of stitching patterns by merely adjusting the positional of the support plate relative to the sewing needle or needles.

In FIG. 2, the support plate 22 is shown in phantom lines positioned with its front edge 28 within the U-shaped channel 37 of guide cap 36 and the stop 54 abutting the cylinder 47. To enable the former to produce hems of different widths, this extreme inward position of the front edge 28 is adjustably limited by the positioning of the stop 54 along the piston rod 52. For example, to produce a wide hem the stop 54 is positioned to allow the support plate front edge 28 to extend well into the channel 37 distally from guide edge 23. Conversely, to produce a narrow hem the stop is positioned to allow the front edge to slightly overhang the guide edge 23. The support plate 22 is forced to this position by directing compressed air through air line 49 into cylinder 47, thereby forcing piston rod 52 inward.

It should be understood that by directing the air flow over the guide edge 23 and through the reciprocating support plate loose threads associated with some materials are restricted from flowing directly into the channels, a problem commonly associated with air hemmers of the prior art having channels extending through the guide edge. This redirecting of the air over the guide edge aids in preventing the material from being dragged back or hanging up within the hemmer during the sewing operation.

From the foregoing, it is seen that a method and former for folding back the margin of a sheet of material is now provided which overcomes problems associated with those of the prior art. It should however be understood that the just described embodiment merely illustrates principles of the invention is a preferred form. Many modifications, additions and deletions may, of course, be made thereto without departure from the spirit and scope of the invention as set forth in the following claims.

What is claimed is:

1. A hem former for folding back the margin of sheet material in preparation for sewing, comprising a support plate having an upper surface and a lower surface, said upper surface and said lower surface merging along an elongated front edge, said support plate having at least one orifice extending from said lower surface adjacent said elongated front edge; first guide means mounted adjacent said elongated front edge for deflecting the margin of the sheet material downward; second guide means mounted beneath said lower surface for aligning and guiding the margin of the sheet material, said support plate mounted for reciprocal movement of said elongated front edge between a first position extending beyond said second guide means and proximal said first guide means and as second position retracted behind said second guide means and distal from said first guide means; means for moving said support plate, and means for generating an airstream flowing beneath said support bottom surface and into said support plate orifice, whereby the margin of sheet material positioned upon the support plate in its first position is urged over the elongated front edge of the support plate and entrained into the air stream flowing from said means for generating an airstream so as to be folded back along said elongated front edge into abutment with the second guide means in preparation for sewing, and whereby the support plate is moved to its second position to complete the sewing of the margin.

2. The hem former of claim 1 wherein said first guide means comprises a block having a U-shaped channel therein.

3. The hem former of claim 1 wherein said second guide means comprises a plate having a generally flat front surface.

4. The hem former of claim 1 wherein said means for generating an airstream comprises an air nozzle.

5. The hem former of claim 1 wherein said orifice is an elongated trough.

6. The hem former of claim 1 further comprising a spring biased plate mounted between said first guide means and said second guide means, said spring biased plate being moveable between a first position providing a select distance between said support plate and said spring biased plate and a second position providing a distance between said first support plate and said spring biased plate greater than said selected distance, whereby an seam within the margin of sheet material is allowed to pass beneath the support plate by biasing said spring biased plate to said second position.

7. A method of folding back a margin of a sheet of material in preparation for sewing with the use of a hem former having first guide means for deflecting the margin of the sheet of material downward, a second guide means for aligning and guiding the margin of the sheet material, a support plate movable between a first position extending beyond the second guide means and proximal the first guide means and a second position retracted behind the second guide means and distal from the first guide means, the support plate having an upper surface and a lower surface extending from the upper surface along an elongated front edge and at least one air intake orifice extending from the lower surface, and means for generating an airstream flowing beneath the support plate lower surface and towards the second guide means, the method comprising the steps of:

(a) positioning a support plate to overhang the second guide means;

(b) advancing the margin of a sheet of material over an upper surface of a support plate in a direction so as to extend beyond a front edge of the support plate;

(c) guiding the margin downward about the front edge of the support plate;

(d) introducing an airstream directed below the support plate in a direction generally opposite to the direction of the sheet advancement over the upper surface and into an orifice within the support plate;

(e) entraining the margin of the sheet of material into the airstream so as to turn down the margin beneath the support plate into abutment with the second guide means thereby folding back the margin of a sheet of material in preparation for sewing; and (f) retracting the support plate behind the second guide means.

8. The method of claim 7 wherein the airstream is continually introduced throughout the sewing of the margin of material.

9. A hem former for folding back the margin of sheet material in preparation for sewing, comprising a support plate having an upper surface and a lower surface, said upper surface and said lower surface merging along an elongated front edge; first guide means mounted adjacent said elongated front edge for deflecting the margin of the sheet material downward; second guide means mounted beneath said lower surface for aligning and guiding the margin of the sheet material, said support plate mounted for reciprocal movement of said elongated front edge between a first position extending beyond said second guide means and proximal said first guide means and as second position retracted behind said second guide means and distal from said first guide means; means for moving said support plate; and a spring biased plate mounted between said first guide means and said second guide means, said spring biased plate being moveable between a first position providing a select distance between said support plate and said spring biased plate and a second position providing a distance between said first support plate and said spring biased plate greater than said selected distance, whereby the margin of sheet material positioned upon the support plate in its first position is urged over the elongated front edge of the support plate and folded back along said elongated front edge into abutment with the second guide means in preparation for sewing, and the support plate is moved to its second position to complete the sewing of the margin, and whereby a seam within the margin of sheet material is allowed to pass beneath the support plate by biasing said spring biased plate to said second position.

10. The hem former of claim 9 wherein said support plate has at least one orifice extending from said lower surface adjacent said elongated front edge and means for generating an airstream flowing beneath said support bottom surface and into said support plate orifice.

11. The hem former of claim 9 wherein said first guide means comprises a block having a U-shaped channel therein.

12. The hem former of claim 9 wherein said second guide means comprises a plate having a generally flat front surface.

13. The hem former of claim 10 wherein said means for generating an airstream comprises an air nozzle.

14. The hem former of claim 10 wherein said orifice is an elongated trough.

* * * * *